US008449738B2

(12) United States Patent
Klut et al.

(10) Patent No.: US 8,449,738 B2
(45) Date of Patent: May 28, 2013

(54) APPARATUS AND METHOD FOR THE REMOVAL OF GASSES

(75) Inventors: Pieter Dirk Klut, Castricum (NL); Petrus Leonardus Verbraak, Weesp (NL)

(73) Assignee: Danieli Corus Technical Services BV, IJmuiden (NL)

( * ) Notice: Subject to any disclaimer, the term of this patent is extended or adjusted under 35 U.S.C. 154(b) by 800 days.

(21) Appl. No.: 12/519,411

(22) PCT Filed: Nov. 27, 2007

(86) PCT No.: PCT/EP2007/010266
§ 371 (c)(1),
(2), (4) Date: Sep. 22, 2009

(87) PCT Pub. No.: WO2008/074386
PCT Pub. Date: Jun. 26, 2008

(65) Prior Publication Data

US 2010/0044217 A1 Feb. 25, 2010

(30) Foreign Application Priority Data

Dec. 21, 2006 (EP) ..... 06026549
Mar. 20, 2007 (EP) ..... 07005634

(51) Int. Cl.
*C25C 3/00* (2006.01)
*C25C 3/06* (2006.01)
*C25C 3/20* (2006.01)
*C25C 3/22* (2006.01)

(52) U.S. Cl.
USPC ..... 204/278; 204/244; 204/247; 204/242

(58) Field of Classification Search
USPC ..... 204/278, 242, 247
See application file for complete search history.

(56) References Cited

U.S. PATENT DOCUMENTS 4,668,352 A 5/1987 Duprat et al.

FOREIGN PATENT DOCUMENTS

GB 2 158 226 A 11/1985

OTHER PUBLICATIONS

Apr. 28, 2011 examination report from Australian application No. 2007334985 to Danieli Corus Technical Services.
"Reduction of Fluoride Emissions", M. Karlsen et al., Proc. 6th Aust. AL Smelting Workshop, 1998, XP002436026, p. 713.

*Primary Examiner* — Harry D Wilkins, III
*Assistant Examiner* — Zulmariam Mendez
(74) *Attorney, Agent, or Firm* — De Vries & Metman

(57) ABSTRACT

An apparatus for the removal of gasses from a number of electrolysis cells, including a suction duct for each cell, each suction duct being connected to a central manifold with a gas treatment center and a central suction fan. A flow restriction device is provided in each suction duct. One or more additional ductworks are provided. Each additional ductwork is for one or more suction ducts. Each additional ductwork has a branch for each suction duct, the branch being connected to the suction duct between the electrolysis cell and the flow restriction device, which one or more branches are connected to a booster duct in which an on/off valve is present. One or more booster ducts are connected to a booster manifold connected to the central manifold. A booster fan is provided in the booster manifold. A method for performing an electrolysis process is also disclosed.

23 Claims, 3 Drawing Sheets

APPARATUS AND METHOD FOR THE REMOVAL OF GASSES

This application is a §371 National Stage Application of International Application No. PCT/EP2007/010266, filed on 27 Nov. 2007 claiming the priority of European Patent Application No. 06026549.3.4 filed on 21 Dec. 2006 and European Patent Application No. 07005634.6 filed on 20 Mar. 2007.

The invention relates to an apparatus for the removal of gasses from a number of electrolysis cells, the apparatus comprising a suction duct for each cell, each suction duct being connected to a central manifold with a gas treatment centre and a central suction fan. The invention also relates to a method for the removal of such gasses.

During the electrolysis process gasses are produced that can be harmful for the environment and the working conditions in the pot room. Especially in the aluminium electrolysis process harmful gasses containing fluorides and fluoride particles are emitted. The last decades major improvements have been implemented to reduce the emission of both fluoride particles and gasses containing fluorides. The emission of the fluoride particles now is at an acceptable level due to an efficient adsorption system. However, the emission of gasses containing fluorides still is a problem for the environment, especially during anode change, tapping and maintenance of the electrolysis cells.

Nowadays the aluminium electrolysis cells are shielded very effectively during the normal operation of the cells. The openings in the cells at both sides are hooded such that approximately 99.5% of the openings are covered. Above the hoods, on each side of the cell a suction duct is provided to extract the gasses containing fluorides that are still emitted. These gasses are led through a manifold to a gas treatment centre, such as a scrubber, using a central suction fan. This normal suction is efficient enough to reduce the emission of the gasses containing fluorides that enter the pot room and are emitted to the environment to an acceptable level.

However, during opening of the hoods of the electrolysis cells for changing of the anodes, tapping and maintenance of the cells much more gasses containing fluorides are emitted in the pot room. To remove these gasses, it is known to use an additional ductwork to extract the fluoride gasses with a booster fan, such that a higher volume of gasses is extracted per hour.

It is an object of the present invention to provide an apparatus for the removal of gasses from a number of electrolysis cells having an additional ductwork that is improved compared to the existing apparatus.

It is a further object of the present invention to provide an apparatus for the removal of gasses from a number of electrolysis cells having an additional ductwork that is easier to build, use and maintain than the existing apparatus.

It is another object of the present invention to provide an apparatus for the removal of gasses from a number of electrolysis cells that is cheaper to build than the existing apparatus.

It is moreover an object of the invention to provide an improved method for removing gasses from electrolysis cells.

According to a first aspect of the invention one or more of these objects are reached by providing an apparatus for the removal of gasses from a number of electrolysis cells, comprising a suction duct for each cell, each suction duct being connected to a central manifold with a gas treatment centre and a central suction fan, wherein a flow restriction device is provided in each suction duct, and wherein one or more additional ductworks are provided, each additional ductwork for one or more suction ducts, wherein each additional ductwork has a branch for each suction duct, the branch being connected to the suction duct between the electrolysis cell and the flow restriction device, which one or more branches are connected to a booster duct in which an on/off valve is present, one or more booster ducts being connected to a booster manifold which is connected to the central manifold, a booster fan being provided in the booster manifold.

Due to the fact that the branches of the additional ductworks are connected to the suction ducts between the electrolysis cell and the flow restriction device, the boosted suction will not be hampered by the flow restriction devices. For each electrolysis cell a flow restriction device has to be present, to be able to perform a normal suction that is approximately equal for each cell. Without flow restriction devices, the gasses from the cells nearest to the central suction fan would be extracted at a much higher volume than the gasses from the cells connected to the central manifold far from the central suction fan, due to the resistance of the central manifold. Since a flow restriction device will cause a resistance to the flow of the gasses, it is advantageous to connect the branches of the additional ductworks to the suction ducts such that the boosted suction is not hampered by the flow restriction devices.

Preferably, each additional ductwork has been provided with two or more suction ducts, preferably each additional ductwork has been provided with two suction ducts. In this way it is not necessary to use an on/off valve for each cell, but only one on/off valve needs to be used for each two or more suction ducts and thus for two or more cells. One additional ductwork for two suction ducts is preferred so as to keep the branches of the ductwork of equal length.

According to a preferred embodiment at least one of the suction ducts that is provided with an additional ductwork is free of valves such as on/off valves, preferably at least half of the suction ducts is free of valves, and more preferably all suction ducts are free of valves. Since the branches of the additional ductworks are connected to the suction ducts between the cells and the flow restriction device in the suction duct, during the boosted suction the gasses that are emitted by the cells are extracted, and no gasses or only a limited amount of gasses are extracted from the central manifold (which still extracts gasses from electrolysis cells where normal suction is used). Thus, it is not necessary to provide an on/off valve in the suction ducts and close these valves during boosted suction. Not having to provide these valves means a major saving in investment costs for an electrolysis plant, which uses hundreds of electrolysis cells. It is even possible that, when the volume of the gasses extracted by the boosted suction is relatively low, the normal suction through the central manifold adds to the boosted suction.

Preferably, the on/off valves in the booster ducts are automatic valves, controlled by a central control unit. Using automatic on/off valves means that the valves need not be operated by hand, which makes the switching of the valves at the right time easier.

According to a preferred embodiment booster ducts for eight to twenty electrolysis cells are connected to one booster manifold. This means that the boosted suction for eight to twenty electrolysis cells can be performed with one booster fan. This booster fan is dimensioned such that only one additional ductwork can be used at a time.

Preferably, each booster duct is connected to two suction ducts, and seven booster ducts are connected to one booster manifold. This means that for an electrolysis plant having 700 electrolysis cells only 350 on/off valves and 50 booster fans are needed, whereas for the known additional ductwork to extract gasses 1400 valves are needed.

According to a preferred embodiment the central suction fan provides a suction volume of 2000 to 10000 N $m^3$/h for each electrolysis cell during use, preferably a suction volume of 4000 to 6000 N $m^3$/h for each electrolysis cell during use. This suction volume is suitable for a normal extraction of gasses by the suction ducts, such that the extraction of gasses from the hooded electrolysis cells is efficient enough to reduce the emission of harmful gasses to the environment to an acceptable level. Usually a central suction fan set configuration is provided for approximately hundred twenty electrolysis cells.

Preferably, the booster fan provides a suction volume for two suction ducts that is two to four times as high as the suction volume provided by the central suction fan for each electrolysis cell during use. With this suction volume, the emission of gasses is reduced to an acceptable level.

According to a preferred embodiment the electrolysis cells are aluminium electrolysis cells. The present invention is especially suitable for the aluminium electrolysis process, but can also be used for other electrolysis processes by which harmful gasses are emitted.

According to a second aspect of the invention one or more of these objects are reached by providing an apparatus for the removal of gasses from a number of electrolysis cells, comprising a suction duct for each cell, each suction duct being connected to a central manifold with a gas treatment centre and a central suction fan, wherein a flow restriction device is provided in each suction duct, wherein an additional ductwork is provided which is releasably connected to the apparatus, the additional ductwork comprising an additional booster duct and one or more branches that are releasably connected to the respective suction ducts of the apparatus between the electrolysis cell and the flow restriction device, wherein the additional booster duct is releasably connected to the central manifold, and wherein the additional ductwork has a booster fan for removing gasses from the electrolysis cells through the suction ducts and the branches into the central manifold.

Here as well the boosted suction will not be hampered by the flow restriction device, since the branche or branches of the additional ductwork are connected to the suction duct between the electrolysis cell and the flow restriction device. However, according to the present apparatus the additional ductwork is provided with a booster fan that is directly connected to the central manifold, without the need for a booster manifold. The additional ductwork can be released from the suction duct or ducts and the central manifold, and used for other electrolysis cells, since the connection with the suction ducts and the central manifold can be released. In this way, no booster duct is needed, and only one booster fan is needed for all electrolysis cells that are connected to one central manifold. Moreover, the booster fan can be smaller than the booster fan as has to be used in the booster manifold.

Preferably, the additional ductwork has two or more branches, preferably two branches, that are releasably connected to the respective suction ducts, or wherein the additional ductwork has one branch that is releasably connected to a connecting duct between two or more suction ducts. In this way the booster fan can be used for two or more electrolysis cells at the same time, or in sequence without needing time for a change of position.

According to a preferred embodiment the additional ductwork is movable along the electrolysis cells and connectable to all the suction ducts of the electrolysis cells. The additional ductwork with the booster fan can for instance be displaced along a rail track so as to make displacement easy and fast.

Preferably, the suction ducts and the central manifold are provided with on/off valves for connection with the additional ductwork. The on/off valves can be opened after the additional ductwork has been connected, and closed before the additional ductwork is released.

According to a third aspect of the invention one or more of these objects are reached by providing an apparatus for the removal of gasses from a number of electrolysis cells, comprising a suction duct for each cell, each suction duct being connected to a central manifold with a gas treatment centre and a central suction fan, wherein a flow restriction device is provided in each suction duct, wherein an additional ductwork is provided which is releasably connected to the apparatus, the additional ductwork comprising an additional booster duct having a branch for removing gasses above an electrolysis cell, wherein the additional booster duct is releasably connected to the central manifold, and wherein the additional ductwork has a booster fan for removing the gasses into the central manifold.

According to this third solution for reaching the objects of the invention, the additional gasses are not removed through the suction duct of the electrolysis cell, but are removed above the electrolysis cell through a branch of the additional ductwork, using a booster fan which removes the gasses into the central manifold. This additional ductwork is more flexible because it has only to be connected to the central manifold, but it is difficult to use between the electrolysis cells and the central manifold.

Preferably the additional ductwork is movable along the electrolysis cells and connectable to the central manifold at different places along that manifold. Thus, the additional ductwork can be displaced along all electrolysis cells that are connected to a central manifold, and no booster manifold is needed.

According to a preferred embodiment the central manifold is provided with one or more on/off valves for connection with the additional ductwork. In this way the additional ductwork can be easily connected to the central manifold along the length thereof.

The invention also relates to a method for performing an electrolysis process, wherein gasses formed during the electrolysis process are removed using an apparatus as described above.

Preferably, the gasses formed are gasses containing fluorides formed during an aluminium electrolysis process using the Hall-Heroult method. These gasses containing fluorides are harmful for the environment and the emission thereof has to be reduced to a very considerable extent, in accordance with government regulations.

According to a preferred method the additional ductworks are used for extraction of gasses when one or more of the electrolysis cells are open.

The invention will be elucidated with reference to the embodiments shown in the drawings.

Figure 1:
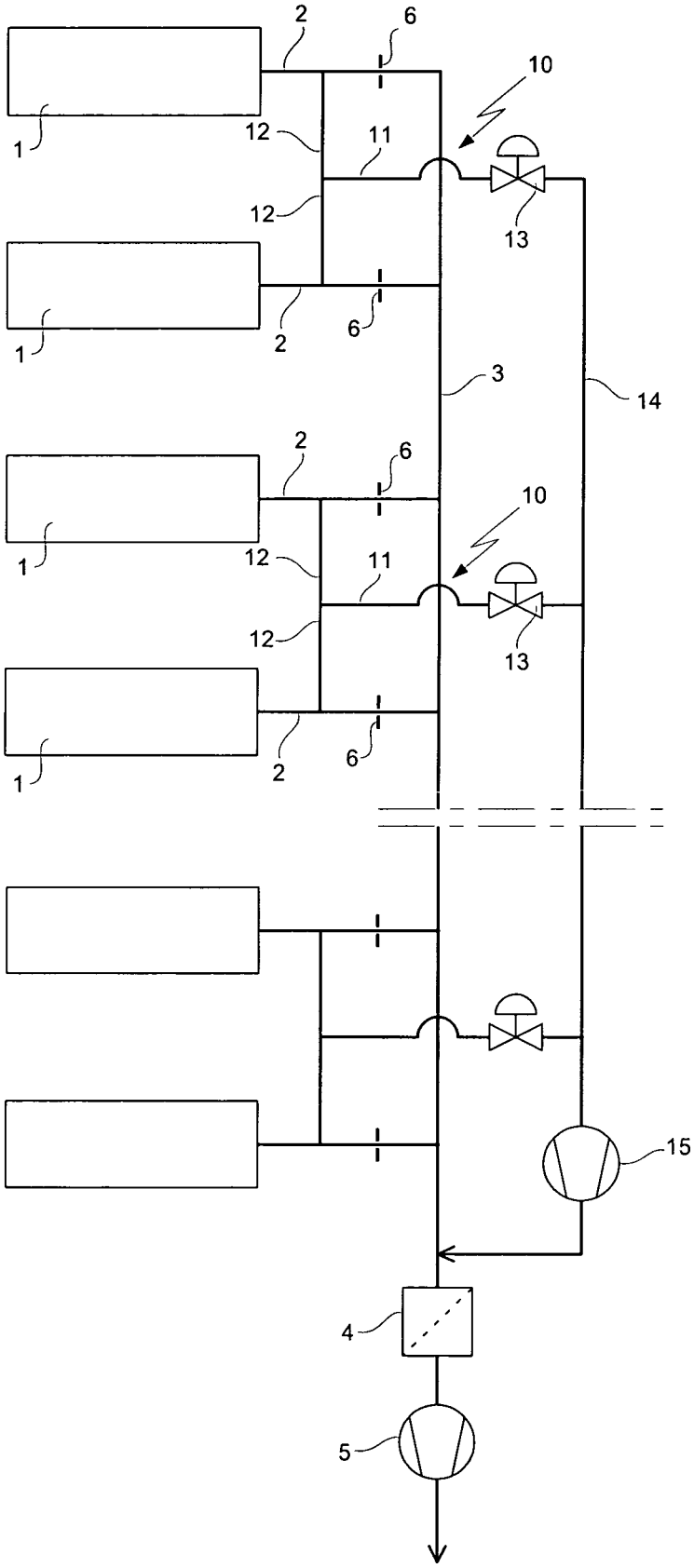
FIG. 1 shows, in a schematic way, a preferred embodiment of a suction system for electrolysis cells according to the present invention.

FIG. 1 shows six aluminium electrolysis cells 1 that are connected by a suction duct 2 for each cell to a central manifold 3. The central manifold 3 ends in a gas treatment centre 4 and a central suction fan 5. The central suction fan 5 usually consists of a number of fans, and normally hundred twenty electrolysis cells 1 are connected to one central manifold 3. In one aluminium electrolysis plant up to ten of such central manifolds with their respective cells and gas treatment centres with central suction fans will be present. For some suction systems, the suction ducts split above the electrolysis cells such that two ducts are present above the cells, one at each side. These ducts above the cells have openings through which the gasses emitted by the cells are extracted.

In each suction duct 2 a flow restriction device 6 is present, such that the volume of the gasses that is extracted from each electrolysis cell is approximately equal for each cell. Without the flow restriction devices, the volume that is extracted from the cell nearest to the central suction fan 5 is much higher than the volume extracted from the cell that is furthest away from the central suction fan 5, due to the resistance of the central manifold 3. The flow restriction of each flow restriction device is adapted to the place of each cell relative to the central suction fan 5.

The above suction system is used during normal operation of the electrolysis process, when the electrolysis cells are hooded or shielded and 99.5% of the openings in the cells are covered.

Additional ductworks are present, to be used when panels in the hoods of the electrolysis cells are (partly) removed for changing of the anodes in the cells, for tapping and for maintenance of the cells.

Typically each additional ductwork 10 consists of a booster duct 11 with two branches 12 that are connected to two suction ducts 2. In the booster duct 11 an on/off valve 13 is present. A number of additional ductworks 10 is connected to a booster manifold 14, in which a booster fan 15 is present. The booster manifold 14 ends in the central manifold 3. Though not shown, usually fourteen cells are connected to a booster manifold 14 through seven ductworks 10, and five or six of such booster manifolds 14 end in one central manifold 3.

The use of the suction system as described above will be explained hereinafter.

During normal operation of the cells all the hoods on the electrolysis cells 1 are present and the openings of the cells are covered for a percentage of at least 99.5%. In this situation, all the on/off valves 13 are closed and the emitted gasses from the electrolysis cells 1 that still escape from the cells are extracted by the suction ducts 2 and the central manifold 3 and treated in the gas treatment centre or scrubber 4 through the working of the central suction fan 5.

When one or more of the panels in the hoods are removed from one or two electrolysis cells 1 that are connected to one and the same additional ductwork 10, the on/off valve 13 for these electrolysis cells 1 is opened and the booster fan 15 is started. Now, the gasses emitted by the electrolysis cells 1 from which panels are removed are extracted by the booster fan 15 through the respective branches 12, booster duct 11 and booster manifold 14.

Since the branches 12 of the additional ductworks 10 are connected to the suction ducts 2 between the electrolysis cells and the flow restriction devices 6, no on/off valves need to be present in the suction ducts 2 to close off the suction ducts to prevent inflow from the central manifold 3 when the additional ductworks are used. The flow restriction devices 6 prevent backflow of gasses from the central manifold 3 to such an extent that no on/off valves in the suctions ducts 2 are needed, which provides a huge cost reduction in building the suction system. The central manifold 3 can even add to the extraction of gasses when the volume of the boosted suction is not too high.

For the usual size of aluminium electrolysis cells the central suction fan 5 should provide a suction flow of approximately 5000 N $m^3$/h in each suction duct 2. To prevent harmful emissions of the electrolysis cells when one or more panels are removed from the hoods, the boosted suction should be two to four times as high, so approximately 15000 N $m^3$/h. However, also other suction flows can be used.

Figure 2:
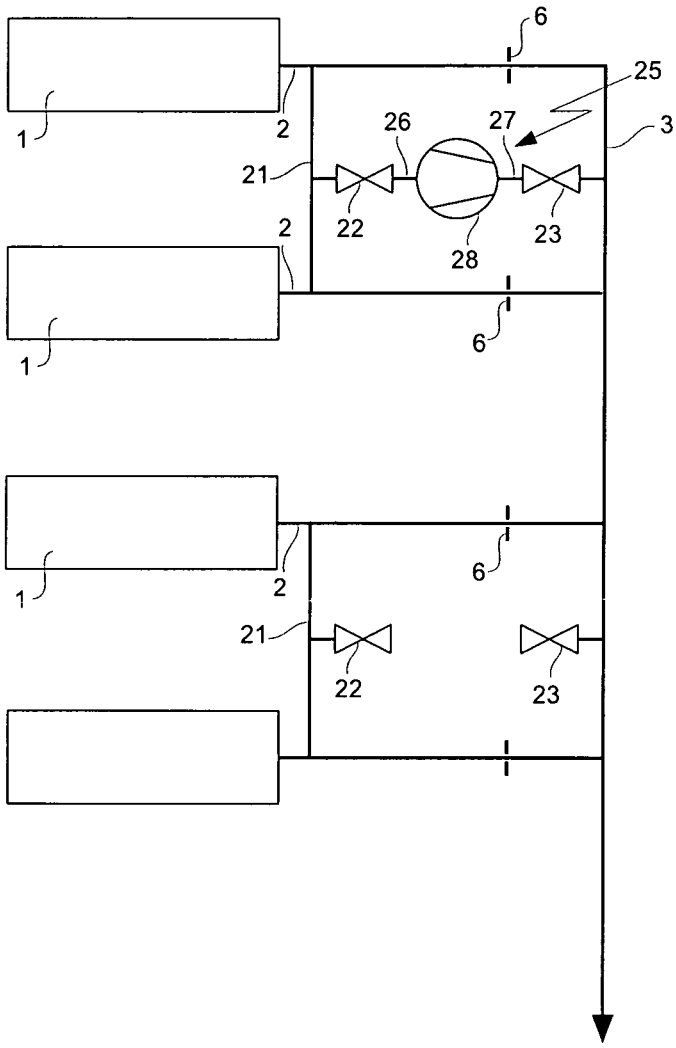
FIG. 2 shows another preferred embodiment of a suction system for electrolysis cells according to the invention with a displaceable additional ductwork.

FIG. 2 shows electrolysis cells 1 that are connected by a suction duct 2 for each cell to a central manifold 3 with a gas treatment centre (not shown) and a central fan (not shown), and in each suction duct 2 a flow restriction device is present. This is the same as in FIG. 1.

According to the present embodiment, two suction ducts are connected by a connecting duct 21 having an on/off valve 22. The central manifold 3 has also been provided with an on/off valve 23 between the suction ducts. The additional ductwork now has a branch 26 for connection to the on/off valve 22, and a duct 27 for connection to the on/off valve 23. A booster fan 28 is present for removing gasses from the suction ducts 1 into the central manifold 3.

The branch 26 and duct 27 can be disconnected from the on/off valves 22 and 23, and thus the additional ductwork 25 can be used for other electrolysis cells. For this, the additional ductwork is preferably movable along the central manifold 3, for instance along a rail track (not shown). In this way, using a lighter booster fan and a minimum of additional ducts, all electrolysis cells can be treated and additional gasses released can be removed.

Figure 3:
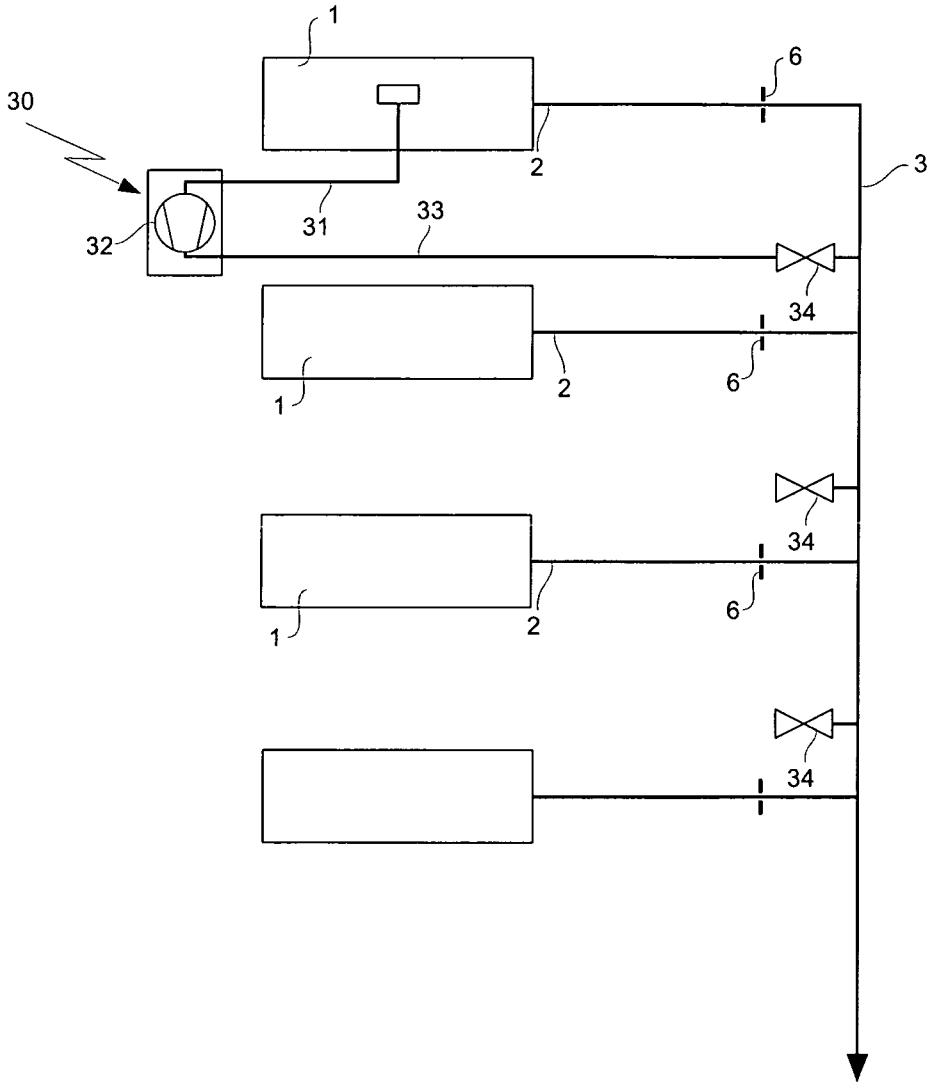
FIG. 3 shows a further embodiment according to the invention.

FIG. 3 again shows electrolysis cells 1 that are connected by a suction duct 2 for each cell to a central manifold 3 with a gas treatment centre (not shown) and a central fan (not shown), and in each suction duct 2 a flow restriction device is present. This is the same as in FIG. 1.

However, here an additional ductwork 30 is used which has a branch 31 for removing gasses from above an electrolysis cell, using a booster fan 32 and a duct 33 that is connected to an on/off valve 34 provided at the central manifold 3.

The additional ductwork is movable along the electrolysis cells and can be used for all electrolysis cells connected to the central manifold, since duct 33 can be disconnected from the on/off valve 34 and connected to another on/off valve provided to the central manifold 3.

For the aluminium electrolysis process, the harmful gasses contain fluorides, but also other polluting elements such as PAH's, SO2, SO3 and dust. PAH's and dust are also removed in the gas treatment centres (PAH is abbreviation of Polycyclic Aromatic Hydrocarbon).

It will be understood by the skilled person that other embodiments of the invention are also possible, such as an embodiment in which for each electrolysis cell a ductwork is provided, and an embodiment in which each ductwork has three or more braches for three or more electrolysis cells. It will also be understood that the number of ductworks connected to the booster duct can be varied.

Moreover, the apparatus and method according to the invention can also be used for other electrolysis process besides aluminium electrolysis.

The invention claimed is:

1. Apparatus for the removal of gasses from a number of electrolysis cells, comprising a suction duct for each cell, each suction duct being connected to a central manifold with a gas treatment centre and a central suction fan, wherein a flow restriction device is provided in each suction duct, and wherein one or more additional ductworks are provided, each additional ductwork for one or more suction ducts, wherein each additional ductwork has a branch for each suction duct, the branch being connected to the suction duct between the electrolysis cell and the flow restriction device, which one or more branches are connected to a booster duct in which an on/off valve is present, one or more booster ducts being connected to a booster manifold which is connected to the central manifold, a booster fan being provided in the booster manifold.

2. Apparatus according to claim 1, wherein each additional ductwork has been provided with two or more suction ducts, preferably each additional ductwork has been provided with two suction ducts.

3. Apparatus according to claim 1, wherein at least one of the suction ducts that is provided with an additional ductwork is free of on/off valves.

4. Apparatus according to claim 1, wherein the on/off valves in the booster ducts are automatic valves, controlled by a central control unit.

5. Apparatus according to claim 1, wherein booster ducts for eight to twenty electrolysis cells are connected to one booster manifold.

6. Apparatus according to claim 5, wherein each booster duct is connected to two suction ducts, and seven booster ducts are connected to one booster manifold.

7. Apparatus according to claim 1, wherein the central suction fan provides a suction volume of 2000 to 10000 N nrVh for each electrolysis cell during use.

8. Apparatus according to claim 7, wherein the booster fan provides a suction volume for two suction ducts that is two to four times as high as the suction volume provided by the central suction fan for each electrolysis cell during use.

9. Apparatus according to claim 1, wherein the electrolysis cells are aluminium electrolysis cells.

10. Apparatus for the removal of gasses from a number of electrolysis cells, comprising a suction duct for each cell, each suction duct being connected to a central manifold with a gas treatment centre and a central suction fan, wherein a flow restriction device is provided in each suction duct, wherein an additional ductwork is provided which is releasably connected to the apparatus, the additional ductwork comprising an additional booster duct and one or more branches that are releasably connected to the respective suction ducts of the apparatus between the electrolysis cell and the flow restriction device, wherein the additional booster duct is releasably connected to the central manifold, and wherein the additional ductwork has a booster fan for removing gasses from the electrolysis cells through the suction ducts and the branches into the central manifold.

11. Apparatus according to claim 10, wherein the additional ductwork has two or more branches, that are releasably connected to the respective suction ducts, or wherein the additional ductwork has one branch releasably connected to a connecting duct between two or more suction ducts.

12. Apparatus according to claim 10, wherein the additional ductwork is movable along the electrolysis cells and connectable to all the suction ducts of the electrolysis cells.

13. Apparatus according to claim 10, wherein the suction ducts and the central manifold are provided with on/off valves for connection with the additional ductwork.

14. Apparatus for the removal of gasses from a number of electrolysis cells, comprising a suction duct for each cell, each suction duct being connected to a central manifold with a gas treatment centre and a central suction fan, wherein a flow restriction device is provided in each suction duct, wherein an additional ductwork is provided which is releasably connected to the apparatus, the additional ductwork comprising an additional booster duct having a branch for removing gasses above an electrolysis cell, wherein the additional booster duct is releasably connected to the central manifold, and wherein the additional ductwork has a booster fan for removing the gasses into the central manifold.

15. Apparatus according to claim 14, wherein the additional ductwork is movable along the electrolysis cells and connectable to the central manifold at different places along that manifold.

16. Apparatus according to claim 14, wherein the central manifold is provided with one or more on/off valves for connection with the additional ductwork.

17. Method for performing an electrolysis process, wherein gasses formed during the electrolysis process are removed using an apparatus according to claim 1.

18. Method according to claim 17, wherein the gasses formed are gasses containing fluorides, formed during an aluminium electrolysis process using the Hall-Heroult process.

19. Method according to claim 17, wherein the additional ductworks are used for suction when one or more of the electrolysis cells are open.

20. Apparatus according to claim 1, wherein at least half of the suction ducts provided with an additional suction ductwork are free of valves.

21. Apparatus according to claim 1, wherein all of the suction ducts provided with an additional suction ductwork are free of valves.

22. Apparatus according to claim 1, wherein the central suction fan provides a suction volume of 4000 to 6000 N $m^3$/h for each electrolysis cell during use.

23. Apparatus according to claim 10, wherein the additional ductwork has two branches releasably connected to the respective suction ducts, or wherein the additional ductwork has one branch releasably connected to a connecting duct between two or more suction ducts.

* * * * *

UNITED STATES PATENT AND TRADEMARK OFFICE

CERTIFICATE OF CORRECTION

PATENT NO. : 8,449,738 B2
APPLICATION NO. : 12/519411
DATED : May 28, 2013
INVENTOR(S) : Klut et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 892 days.

Signed and Sealed this
Eighth Day of September, 2015

Michelle K. Lee

Michelle K. Lee
*Director of the United States Patent and Trademark Office*